US006933494B2

(12) United States Patent
Kato et al.

(10) Patent No.: US 6,933,494 B2
(45) Date of Patent: Aug. 23, 2005

(54) OPTICAL SENSOR HEADS EXHIBITING REGULARITY IN OPTICAL CHARACTERISTICS AND OPTICAL SENSOR SYSTEM USING THE SAME

(75) Inventors: Tadaharu Kato, Shizuoka-ken (JP); Tomoyuki Ura, Shizuoka-ken (JP); Tsutomu Sasaki, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 322 days.

(21) Appl. No.: 10/418,021

(22) Filed: Apr. 17, 2003

(65) Prior Publication Data

US 2003/0201386 A1 Oct. 30, 2003

(30) Foreign Application Priority Data

Apr. 25, 2002 (JP) ..... 2002-123744

(51) Int. Cl.[7] ..... H01J 5/02
(52) U.S. Cl. ..... 250/239; 250/221
(58) Field of Search ..... 250/239, 221, 250/227.22, 227.21; 369/44.14, 44.23, 44.32; 84/639, 724; 385/15

(56) References Cited

U.S. PATENT DOCUMENTS 5,783,818 A * 7/1998 Manabe et al. ..... 250/239
5,804,816 A 9/1998 Yamamoto et al.
5,909,028 A 6/1999 Yamamoto

* cited by examiner

*Primary Examiner*—Que T. Le
(74) *Attorney, Agent, or Firm*—Harness, Dickey & Pierce, P.L.C.

(57) ABSTRACT

An optical sensor system includes a light emitting unit, a light detecting unit, light radiating optical sensor heads connected through optical fibers to the light emitting unit and light receiving optical sensor heads connected through optical fibers to the light detecting unit, and light is selectively distributed to the light radiating optical sensor heads for radiating light beams from both side surfaces of each sensor head to the adjacent light receiving optical sensor heads for converting the incident light to photo-current; each light radiating optical sensor head has prisms for splitting the light into two beams; however, the stray light is produced at the edge between the reflection surfaces; the stray light is reduced or predictably controlled by forming textured pattern on the side surfaces, a photo-shield member or notches; otherwise, the edge is sharpened by separately forming the prisms.

29 Claims, 9 Drawing Sheets

OPTICAL SENSOR HEADS EXHIBITING REGULARITY IN OPTICAL CHARACTERISTICS AND OPTICAL SENSOR SYSTEM USING THE SAME

FIELD OF THE INVENTION

This invention relates to optical sensor heads and, more particularly, to an optical sensor heads for radiating light beams to moving objects and the optical sensor system using the same.

DESCRIPTION OF THE RELATED ART

A typical example of the optical sensor system is disclosed in Japan Patent Application laid-open No. 9-152871. Japan Patent Application No. hei 7-313185 was laid open as the Japan Patent Application laid-open No. 9-152871. A U.S. Patent Application was filed claiming the Priority Right on the basis of the Japan Patent Application, and U.S. Pat. No. 5,804,816 was assigned to the U.S. Patent Application.

The prior art optical sensor system is used in a keyboard musical instrument for monitoring the keys. The prior art optical sensor system includes shutter plates respectively attached to the keys, light radiating optical sensor heads and light receiving optical sensor heads. The light radiating optical sensor heads are alternated with the light receiving optical sensor heads, and light beams are radiated from both side surfaces of each light radiating sensor head to the light receiving optical sensor heads disposed on both sides thereof. The light beams across the trajectories of the shutter plates. While a player is depressing the key, the shutter plate is moved along the trajectory, and gradually interrupts the light beam. The shutter motion results in reduction of the amount of light incident on the light receiving optical sensor, and a controller determines the present key position on the basis of the amount of incident light.

FIG. 1 shows a pair of optical sensor heads 123/133 incorporated in another prior art optical sensor system. A light emitting device (not shown) is connected through an optical fiber 140 to the optical sensor head 123, and light is propagated through the optical fiber 140 to the optical sensor head 123. The light is split into two light beams R, and the two light beams R are radiated to the optical sensor heads 133, only one of which is shown in FIG. 1. The light beam R is incident on the optical sensor head 133, and the incident light is propagated through an optical fiber 150 to a light detecting device (not shown). Thus, the optical sensor heads 123 and 133 serve as the light radiating optical sensor head and light receiving optical sensor head, respectively.

The light radiating optical head 120 is made of transparent synthetic resin such as acrylic resin, and broken down into a body portion 120*a* and a light output portion 120*b*. The body portion 120*a* has a generally rectangular parallelepiped shape, and is formed with a guide groove 120*c*. The optical fiber 140 is inserted into the guide groove 120*c*. The optical fiber 140 is made of transparent synthetic resin such as acrylic resin, and is of the order of 0.5 millimeter thick. The optical fiber 140 has a light output end 122, and the light output end 122 is held in contact with an inner surface partially defining the groove 120*c*. The guide groove 120*c* has a centerline, which is coincident with the center axis of the optical fiber 140, and the light is radiated from the light output end 122 toward the light output portion 120*b*.

The light output portion 120*b* projects from the body portion 120*a*, and is formed with convex lenses 121L/121R. The convex lenses 121L/121R are symmetrical with respect to the extension of the centerline of the groove 120*c*, and have reflection surfaces 123*b*/123*c*. The reflection surfaces 123*b*/123*c* are diverged from an edge line 123*a*, and the optical axes of the convex lenses 121L/121R and the center axis of the optical fiber 140 intersect the edge line 123*a*. The light proceeds to the reflection surfaces 123*b*/123*c*, and is split into two light beams R at the edge line 123*a*. The reflection surfaces 123*b* and 123*c* are spaced from the extension line of the center axis of the optical fiber 140 by 45 degrees so that the two light beams R are respectively directed toward the convex lenses 121L/121R through the reflection on the surfaces 123*c*/123*b*.

The light receiving optical sensor head 130 is also made of the transparent synthetic resin, i.e., acrylic resin, and is also broken down into a body portion 130*a* and a light input portion 130*b*. The body portion 130*a* and light input portion 130*b* are corresponding to the body portion 120*a* and light output portion 120*b*, respectively. The optical fiber 150 is made of acrylic resin, and is of the order of 0.5 millimeter. The optical fiber 150 is held in contact at an ling input end 132 with an inner surface of the body portion 130*a*, and is connected at the other end to a light detecting device (not shown). The light input portion 130*b* has convex lenses 131L/131R, and the reflection surface 133*b* intersects the other reflection surface 133*c* at an edge line 133*a*.

The convex lens 121R is virtually split into two halves 121R*a* and 121R*b* with respect to a virtual plane defined by the edge line 123*a* and optical axis of the convex lens 121R. The arrangement of the convex lenses 131L, 131R, reflection surfaces 133*c*/133*b* and optical fiber 150 is same as that of the convex lenses 121L, 121R, reflection surfaces 123*c*/123*b* and optical fiber 140. For this reason, the convex lens 131L is virtually split into halves 131L*a* and 131L*b* without respect to the virtual plane defined by the optical axis of the convex lens 131L and the edge line 133*a*.

The light radiating optical sensor heads 120 and light receiving optical sensor heads 130 are produced through a molding process. Molding die units are prepared for the light radiating optical sensor heads 120 and light receiving optical sensor heads 130, respectively, and acrylic resin is injected into the molding die units for forming the acrylic resin into the light radiating sensor heads 120 and light receiving sensor heads 130.

The light proceeds as follows. The light is output from the light output end 122 of the optical fiber 140, and proceeds to the reflection surfaces 123*b*/123*c*. The light is split into two light beams at the edge line 123*a*, and the two light beams are incident on the reflection surfaces 123*b*/123*c*. The light beams change their directions at 90 degrees through the reflection on the surfaces 123*b*/123*c*, and proceed to the convex lenses 121R/121L, respectively.

The light beams similarly behave so that description is focused on the rightward proceeding light beam R. The light beam R passes through the half 121R*a* of the convex lens 121R, and the convex lens 121 makes the rays of the light beam R parallel to one another. The light beam R rightward proceeds toward the light receiving optical sensor head 130, and is incident on the haft 131L*a* of the convex lens 131L.

The light beam R proceeds toward the reflection surface 133*c* through the light input portion 130*b*, and is reflected on the surface 133*c*. The rays of the reflected light beam are concentrated on the light input end 132 of the optical fiber 150. The light is propagated through the optical fiber 150 to the light detecting device, and is converted to photo-current.

If any obstacle is not on the optical path of the light beam R, the amount of incident light is maximized. However, when the shutter plate enters the optical path, the amount of incident light is reduced depending upon the position of the shutter plate. Thus, the present shutter position has the influence on the amount of photo-current.

As described hereinbefore, the light radiating optical sensor heads 120 and light receiving optical sensor heads 130 are formed through the molding process. The light radiating optical sensor heads 120 are geometrically identical with one another, and the light receiving optical sensor heads 130 are also geometrically identical with one another. If the light receiving optical sensor heads 130 are exactly disposed at the target positions on both sides of each light radiating optical sensor head 120, the amount of incident light at each light receiving optical sensor head 130 is to be equalized to the amount of incident light at another light receiving optical sensor head 130. In other words, the optical sensor system is to be installed without any calibration. However, the amount of incident light is dispersed among the light receiving optical sensor heads 130. The manufacturer individually measures the amount of photo-current for the light receiving optical sensor heads 130, and calibrates the light detecting devices. Thus, a problem is encountered in the prior art optical sensor heads 120/130 in the poor uniformity in the optical characteristics.

Another document is U.S. Pat. No. 5,804,816. The prior art optical sensor head is split into two parts, and one of the parts is formed with a pair of prisms. Although the prisms have respective reflection surfaces, U.S. Pat. No. 5,804,816 is silent to the shape of the edge between the reflection surfaces.

SUMMARY OF THE INVENTION

It is therefore an important object of the present invention to provide an optical sensor head, which exhibits good uniformity in optical characteristics.

It is also an important object of the present invention to provide an optical sensor system, which is installed without complicated calibration work.

The present inventors contemplated the problems inherent in the prior art optical sensor heads, and found the reflecting surfaces 123*b*/123*c* not to form a sharp edge line 123*a*. The dull edge line 123*a* caused the light to be irregularly reflected as indicated by broken lines R1/R2 in FIG. 1, and the irregular reflection passed through the other half 121R*b* of thee convex lens 121R, and proceeded to the light receiving optical sensor head 130 along the broken lines R1/R2. The irregular reflection was incident onto the other half 131L*b* of the convex lens 131L, and was partially directed to the light input end 132 through multiple irregular reflection. Another part of the irregular reflection returned to the light radiating optical sensor head 120. The part of irregular reflection was incident on the light output portion 120*b*, and was directed to the light receiving optical sensor head 130, again, through multiple irregular reflection.

Since the edge line 133*a* was also differently shaped, part of the incident light might be reflected on the edge line 133*a* to the light input end 132. The shape at the edge line 123*a* was different among the light radiating optical sensor heads 120, and, accordingly, the amount of irregular reflection was not presumable. Similarly, the edge line 133*a* was unintentionally shaped, and the amount of light undesirably incident on the light input end 132 was not controllable.

The irregular shapes of the edge lines 123*a*/133*a* were unavoidable in so far as the optical sensor heads 120/130 were produced through the molding process. The present inventors concluded that the optical sensor heads required a means for suppressing the irregularly reflected light.

In accordance with one aspect of the present invention, there is provided an optical sensor head comprising a body portion having an optical path for light, and a head portion connected to the body portion, formed with reflection surfaces extending from an edge on the optical path in different directions for splitting the light into plural beams through reflection thereon and having a stray light reducing member for reducing the amount of stray light unavoidably produced at the edge.

In accordance with another aspect of the present invention, there is provided an optical sensor head comprising a body portion having an optical path for light, and a head portion connected to the body portion, formed with reflection surfaces extending from an edge on the optical path in different directions for splitting the light into plural beams through reflection thereon and having a stray light controller for making the amount of stray light at the edge predictable.

In accordance with yet another aspect of the present invention, there is provided an optical sensor system for converting present positions of moving objects to electric signals comprising a light emitting unit for emitting light, at least one light radiating optical sensor head connected through an optical fiber to the light emitting unit and including a body portion offering an optical path to the light and a head portion connected to the body portion, formed with reflection surfaces extending from an edge on the optical path in different directions for splitting the light into light beams through reflection thereon and having a suppressing member for reducing fluctuation of the amount of the light beams, at least two light receiving optical sensor heads sideward spaced from the at least one light radiating optical sensor head for permitting the moving objects to pass through gaps, and respectively receiving the light beams, and a light detecting unit connected through optical fibers to the at least two light receiving optical sensor heads, respectively, and converting the light beams to the electric signals.

BRIEF DESCRIPTION OF THE DRAWINGS

The features and advantages of the optical sensor heads and optical sensor system will be more clearly understood from the following description taken in conjunction with the accompanying drawings, in which.

DESCRIPTION OF THE PREFERRED EMBODIMENTS

First Embodiment

Figure 1:
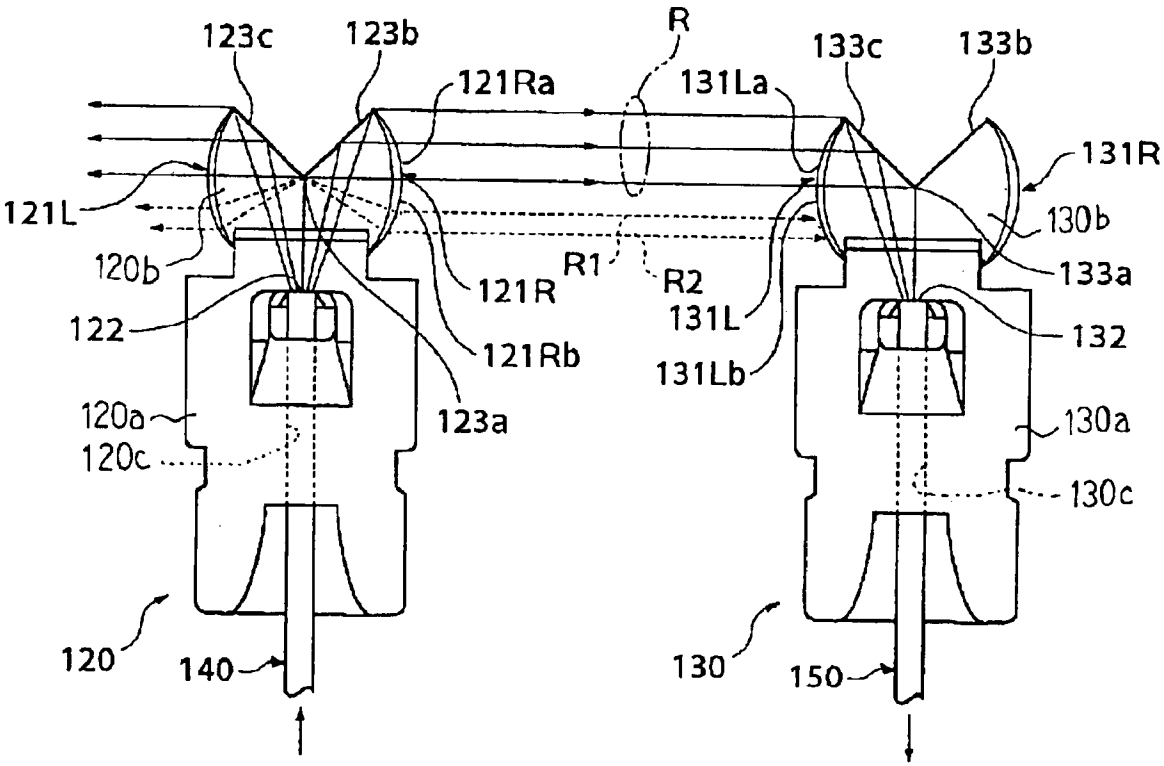
Fig. 1 PRIOR ART
FIG. 1 is a bottom view showing the configuration of the optical sensor heads incorporated in the prior art optical sensor system.
Figure 2:
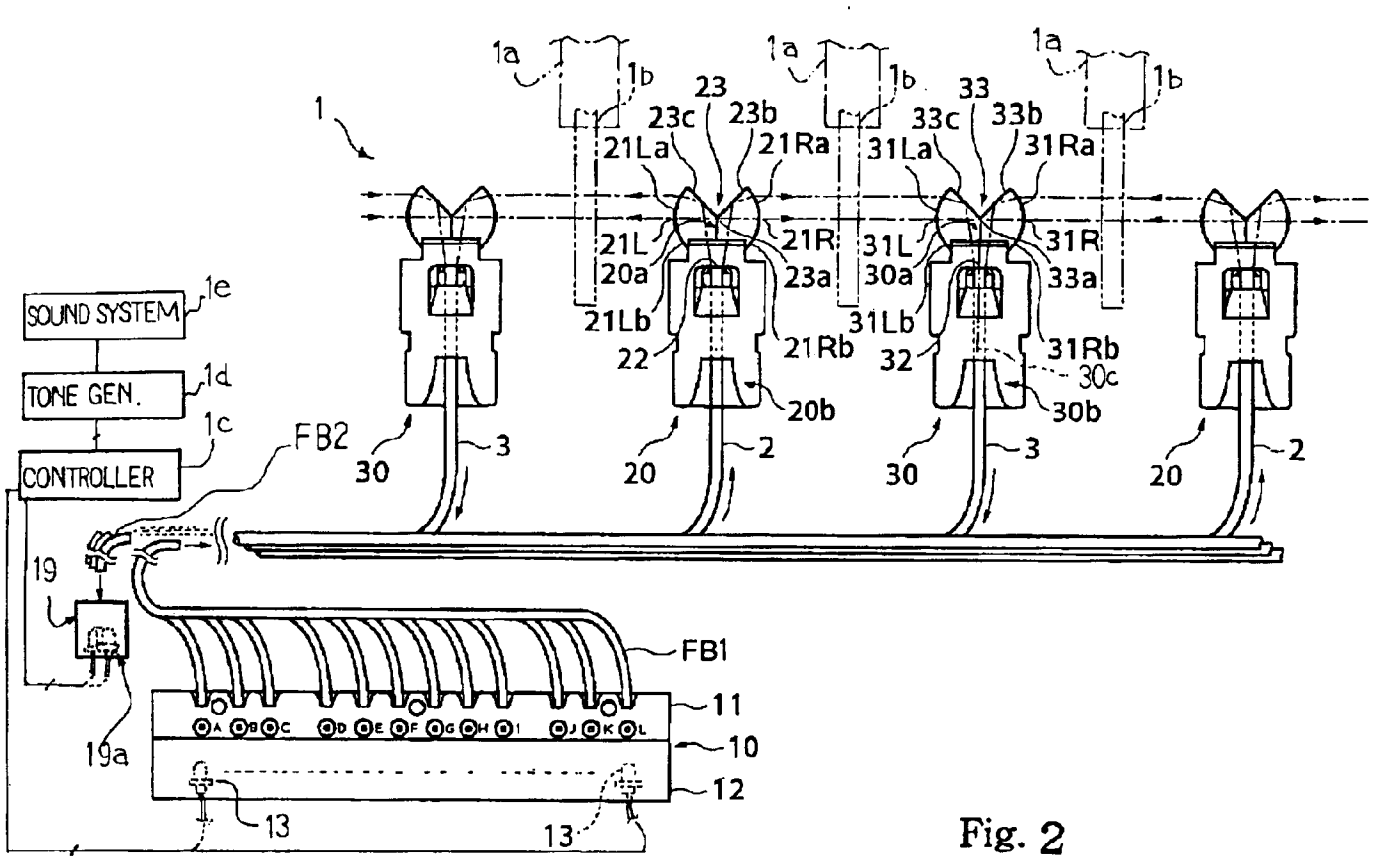
FIG. 2 is a bottom view showing the arrangement of an optical sensor system according to the present invention.

Referring to FIG. 2 of the drawings, an optical sensor system 1 embodying the present invention comprises shutter plates 1*b*, optical fibers 2 and 3, a light emitting unit 10, a light detecting unit 19, light radiating optical sensor heads 20 and light receiving optical sensor heads 30. The light radiating sensor heads/light receiving sensor heads 20/30 have respective planes of symmetry, and term "longitudinal" modifies a direction parallel to the planes of symmetry. On the other hand, term "lateral" modifies the direction perpendicular to the longitudinal direction.

The shutter plates 1*b* are respectively secured to moving objects such as, for example, keys 1*a* incorporated in a keyboard musical instrument. The keyboard musical instrument is of a composite musical instrument between an acoustic piano and an electronic piano. The composite keyboard musical instrument is named "silent piano". The silent piano largely comprises an acoustic piano, i.e., either grand or upright piano, a hammer stopper and an electronic tone generating system. The silent piano has at least an acoustic mode and a silent mode.

While the hammer stopper is staying at a free position, the hammer stopper keeps itself out of the trajectories of the hammers, and permits a pianist to play a music passage through the acoustic piano tones. The pianist is assumed to change the hammer stopper to the blocking position. The hammer stopper enters the trajectories of the hammers. While the pianist is fingering on the keyboard, the depressed keys actuate the associated action units, and the actuated action units make the associated hammers driven for rotation as usual. However, the hammers rebound on the hammer stopper before striking the strings. Thus, any acoustic tone is never generated. Instead, the electronic tone generating system generates electronic tones.

In detail, the optical sensor system 1 is provided for the keyboard. The shutter plates 1*b* are secured to the lower ends of the keys 1*a*. A standard acoustic piano has eighty-eight keys 1*a*, and, accordingly, eighty-eight shutter plates 1*b* downward project from the associated keys 1*a*. An array of light radiating optical sensor heads 20 and light receiving optical sensor heads 30 is provided under the array of keys 1*a*. The total number of optical sensor heads 20/30 is eighty-eight plus one. The light radiating optical sensor heads 20 are alternated with the light receiving optical sensor heads 30. Each of the light radiating optical sensor heads 20 sideward radiates two light beams toward the adjacent light receiving optical sensor heads 30, and the light receiving optical sensor heads 30 receives the light beams from the adjacent light radiating optical sensor heads 20. Plural time slots are selectively assigned to the light radiating optical sensor heads 20 in such a manner that any light receiving optical sensor head 30 does not concurrently receives two light beams from the adjacent light radiating optical sensor heads 20. Each light beam laterally extends across the trajectory of associated one of the shutter plates.

When the pianist depresses one of the keys 1*a*, the depressed key 1*a* is downwardly moved together with shutter plate 1*b*, and the light beam is gradually interrupted with the shutter plate 1*b*. The overlapped area between the light beam and the shutter plate 1*b* is increased, and the amount of light incident on the associated light receiving optical sensor head 30 is gradually decreased. The variation of incident light is reported from the optical sensor system 1 to a controller 1*c*, which is incorporated in the electronic tone generating system. The controller 1*c* specifies the depressed key, and calculates the velocity. The controller 1*c* produces a music data code representative of the depressed key 1*a*, and a tone generator 1*d*, which also forms a part of the electronic tone generating system, produces a digital tone signal on the basis of the music data code. The digital tone signal is converted to an analog audio signal, which in turn is converted to an electronic tone through a sound system 1*e*. Thus, the silent piano generates the electronic tones instead of the acoustic piano tones.

The components 2, 3, 10, 19, 20 and 30 are hereinafter described in more detail. The optical fibers 2 are made of transparent synthetic resin such as, for example, acrylic resin, and are 0.5 millimeter thick. The optical fibers 2 form bundles FB1, and the bundles FB1 of optical fibers 2 are respectively connected to light output ports A, B, C, D, E, F, G, H, I, J, K and L of the light emitting unit 11. The optical fibers 2 are separated from each other at the other end portions, and are connected to the light radiating optical sensor heads 2, respectively. The light output ports A to L are respectively assigned the time slots, and the light emitting unit 10 sequentially radiates the light from the light output ports A to L into the bundles FB1 of optical fibers 2. The light is incident onto the bundles BF1 of optical fibers 2. The light is propagated through the individual optical fibers 2, and reaches the light emitting optical sensor heads 20. Thus, the optical fibers 2 offer the optical paths for the outward journey to the light.

The optical fibers 3 are also made of transparent synthetic resin such as, for example, acrylic resin, and are 0.5 millimeter thick. The optical fibers 3 are respectively connected to the light receiving optical sensor heads 30, and form plural bundles FB2. Each of the bundles FB2 consists of the optical fibers 3, which respectively receive the incident light from the associated light receiving optical sensor heads 30 at different time slots. In other words, each bundle FB2 does not include two optical fibers 3 concurrently propagating the incident line to the light detecting unit 19. The bundles FB2 of optical fibers 3 are connected to the light detecting unit 19. Thus, the optical fibers 3 offer optical paths for the homeward journey to the light.

The light emitting unit 10 includes an optical coupler 11/12 and plural light emitting devices 13 such as, for example, light emitting diodes. The light emitting devices 13 are respectively associated with the light output ports A to L, and the controller sequentially energizes the light emitting devices 13 so as to distribute the light to the light output ports A to L in the respective time slots. The optical coupler is broken down into an optical plug 11 and a device holder 12. The light emitting devices 13 are secured to the device holder 12. The optical plug 11 is formed with the light output ports A to L, and the bundles FB1 of optical fibers 2 are snugly received in the light output ports A to L, respectively. The optical plug 11 is assembled with the device holder 12. Then, the light emitting devices 13 are respectively opposed to the bundles FB1 of optical fibers 2.

The light detecting unit 19 includes plural light detecting devices 19*a* such as, for example, photo-transistors. The light detecting devices 19*a* are respectively assigned to the bundles FB2 of optical fibers 3, and convert the light to electric charge. The amount of electric charge is proportional to the amount of incident light so that the shutter position is represented by the potential level of the electric signal supplied from the light detecting unit 19 to the controller 1*c*. The optical fibers 3 of each bundle FB2 radiate the light to the associated light detecting device 19*a* in the different time slots. For this reason, the controller 19 is able to determine what key 1*a* is moved on the basis of the combination of the light emitting device 13 and light detecting device 19*a*. The control method for the light emitting unit 10 and light detecting unit 19 is disclosed in Japan Patent Application laid-open No. hei 9-152871.

Figure 3A:
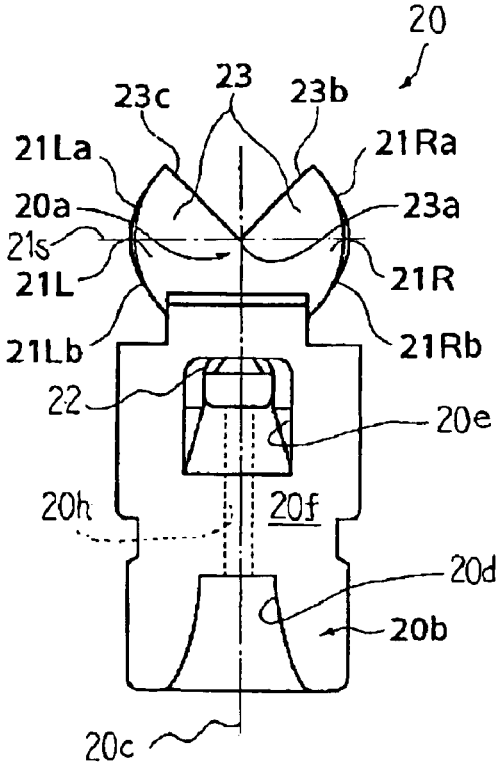
FIG. 3A is a bottom view showing the configuration of a light radiating optical sensor head incorporated in the optical sensor system.
Figure 3B:
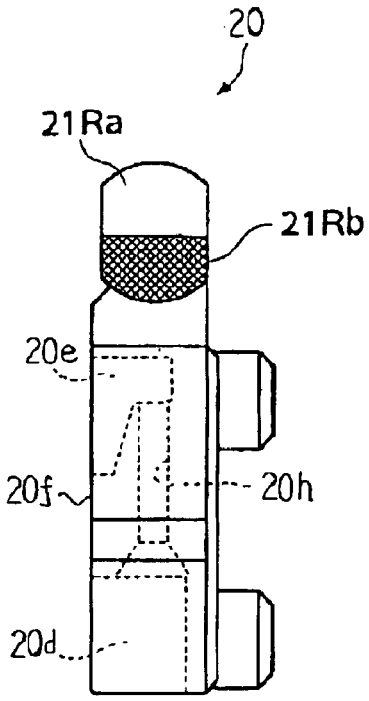
FIG. 3B is a side view showing the light radiating optical sensor head.

The light radiating optical sensor heads 20 are made of transparent synthetic resin such as, for example, acrylic resin, and are shaped through a molding process. For this reason, the light radiating optical sensor heads 20 are identical with one another. Description is made on one of the light radiating optical sensor heads 20 with reference to FIGS. 3A and 3B.

Although the light radiating optical sensor head 20 is monolithic, the light radiating optical sensor head 20 is imaginarily broken down into a light output head portion 20*a* and a body portion 20*b*. The light radiating optical sensor head 20 is symmetrical with respect to a plane 20*c* of symmetry.

The light output head portion 20*a* is formed with a pair of prisms 23 and convex lenses 21L/21R. The pair of prisms 23 are held in contact with one another at an edge line 23*a*, and have respective reflection surfaces 23*b*/23*c*. The reflection surfaces 23*b*/23*c* are merged with each other at the edge line 23*a*, and gradually spaced from each other along the plane of symmetry 20*c*. In other words, the distance between the plane of symmetry 20*c* and the reflection surfaces 23*b*/23*c* is increased. The reflecting surfaces 23*b*/23*c* are inclined at 45 degrees with respect to the plane of symmetry 20*c*. In other words, the reflection surfaces 23*b* and 23*c* are spaced from each other by 90 degrees.

The convex lenses 21R and 21L sideward project from the prisms 23, respectively. Each of the convex lenses 21R/21L is imaginarily split into two halves 21R*a*/21R*b* or 21L*a*/21L*b* with respect to a plane of symmetry 21*s*. The plane 21*s* of symmetry intersects the plane 20*c* of symmetry at the edge line 23*a*. The half 21R*a* of the convex lens 21R and the half 21L*a* of the other convex lens 21L are mirror finished. However, the other halves 31R*b* and 21L*b* are roughened like textured surfaces. The textured surfaces 21R*b*/21L*b* cause the light scattered through the irregular reflection/refraction. For this reason, the amount of light passing through the halves 21R*b*/21I*b* is drastically reduced.

The body portion 20*b* is formed with pits 20*d* and 20*e*, and the pits 20*d*/20*e* are open on the reverse surface 20*f* of the body portion 20*b*. The pit 20*d* is connected to the other pit 20*e* through a guide hole 20*h*. The guide hole 20*h* has a centerline, which extends on the plane 20*c* of symmetry, and the guide hole 20*h* is approximately equal in diameter to the optical fiber 2. A mouth 22 projects into the pit 20*e*, and a concave is defined in the mouth 22. The concave is converged from the entrance to the bottom. Although the entrance is larger in diameter than the optical fiber 2, the bottom is approximately equal in diameter to the optical fiber 2. The concave has a centerline substantially coincident with the centerline of the guide hole 20*h*.

The optical fiber 2 is connected to the light radiating optical sensor head 20 as follows. An assembling worker roughly aligns the optical fiber 2 with the guide hole 20*h*, and inserts the optical fiber 2 through the pit 20*d* into the guide hole 20*h*. The assembling worker further pushes the optical fiber 2 into the guide hole 20*h*. Then, the leading end of the optical fiber 2 reaches the mouth 22. The assembling worker further pushes the optical fiber 2. Then, the mouth 22 is resiliently deformed, and is pinched in the mouth 22. The leading end of the optical fiber 2 is brought into contact with the bottom surface of the mouth 22, and the resiliently deformed mouth 22 keeps the optical fiber 2 held in contact with the bottom surface. For this reason, the light enters the body portion, and proceeds to the light output head portion 20*a* along the plane 20*c* of symmetry.

Turning back to FIG. 2, the light receiving optical sensor heads 30 are also made of transparent synthetic resin such as, for example, acrylic resin, and are shaped through a molding process. For this reason, the light receiving optical sensor heads 30 are identical with one another.

The light receiving optical sensor head 30 is also symmetrical with respect to a plane 30*c*, and is imaginarily broken down into a light input head portion 30*a* and a body portion 30*b*. A pair of prisms 33 and convex lenses 31L/31R are formed in the light input head portion 30*a*. The pair of prisms 33 are held in contact with one another at an edge line 33*a*, and have respective reflection surfaces 33*b*/33*c*. The reflection surfaces 33*b*/33*c* are merged with each other at the edge line 33*a*, and gradually spaced from each other along the plane of symmetry 30*c*. In other words, the distance between the plane of symmetry 30*c* and the reflection surfaces 33*b*/33*c* is increased. The reflecting surfaces 33*b*/33*c* are inclined at 45 degrees with respect to the plane of symmetry 30*c*. In other words, the reflection surfaces 33*b* and 33*c* are spaced from each other by 90 degrees.

The convex lenses 31R and 31L sideward project from the prisms 33, respectively. Each of the convex lenses 31R/31L is imaginarily split into two halves 31R*a*/31R*b* or 31L*a*/31L*b* with respect to a plane of symmetry, which intersects the plane 30*c* of symmetry at the edge line 33*a*. In this instance, the halves 31L*b*/31R*b* are also roughened like the textured surfaces 21R*b*/21L*b*. The textured surfaces 31L*b*/31R*b* make the incident light irregularly reflected on and refracted therein so that the amount of light incident is drastically reduced.

The textured surfaces 21L*b*/21R*b* and 31R*b*/32L*b* are transferred from the molding die unit to the convex lenses 21L/21R and 31R/31L in the molding process. The molding die units have curved inner surfaces corresponding to the convex lenses 21L/21R and convex lenses 31R/31L. The curved surfaces are partially mirror finished and partially textured. When the synthetic resin is solidified in the molding die units, the texture pattern is transferred to the halves 21R*b*/21L*b* of the light radiating optical sensor heads 20 and the halves 31R*b*/31L*b* of the light receiving optical sensor heads 30. Thus, the manufacturer easily roughens the halves of the convex lenses 21R/21L and 31R/31L.

The body portion 30*b* is formed with pits, and the pits are open on the reverse surface of the body portion 30*b*. The pits are connected to each other through a guide hole as similar to the pits 20*d* and 20*e*. The guide hole has a centerline, which extends on the plane 30*c* of symmetry, and the guide hole is approximately equal in diameter to the optical fiber 3. A mouth 32 projects into the pit, and a concave is defined in the mouth 32. The concave is converged from the entrance to the bottom. Although the entrance is larger in diameter than the optical fiber 3, the bottom is approximately equal in diameter to the optical fiber 3. The concave has a centerline substantially coincident with the centerline of the guide hole. Thus, the light receiving optical sensor heads 30 are identical in shape with the light radiating optical sensor heads 20.

The optical sensor system 1 behaves as follows. When the optical sensor system 1 is energized, the controller 1*c* starts to sequentially supply a key scan pulse signal to the associated light emitting devices 13 in the time slots, and repeats the distribution of the key scan pulse signal. The controller 1*c* further starts to convert the potential level of the electric signals respectively output from the light detecting devices 19*a* to digital codes, and checks the digital codes to see whether or not a pianist depresses or releases any one of the keys 1*a*.

The key scan pulse signal causes the light emitting devices 13 to emit the light toward the light output ports A to L, and the light enters the bundles FB1 of optical fibers 2. The light output port L is assumed to be connected through the optical fiber 2 to the light radiating optical sensor head 20 disposed at the second position from the left in FIG. 2. When the rightmost light emitting device 13 is energized with the key scan pulse signal, the light enters the optical fibers connected to the light output port L, and are propagated through the optical fibers 2 to the light radiating optical sensor heads 20. The light reaches the light radiating optical sensor head 20 at the second position, and the light enters the body portion 20*b* of the light radiating optical sensor head 20. The light proceeds to the pair of prisms 23 and is split into two light beams respectively incident on the reflection surfaces 23*b*/23*c*. The light beams are reflected on the reflection surfaces 23*b*/23*c*, respectively, and are directed to the convex lenses 21R and 21L, respectively.

The light beams are radiated from the halves 21R*a*/21L*a* of the convex lenses 21R/21L, and the convex lenses 21R/21L make the rays of the light beams parallel. The light beams proceed to the adjacent light receiving optical sensor heads 30 on both sides of the light radiating optical sensor head 20, and are incident onto the light input head portions 30*a* of the light receiving optical sensor heads 30, respectively. The convex lenses 31L/31R concentrate the light beams on the optical fibers 3, and the incident light enters the optical fibers 3. The incident light is propagated through the optical fibers 3 to the associated light detecting devices 19*a*, and the light detecting devices 19*a* convert the incident light to the electric signals. The electric signals are supplied from the light detecting unit 19 to the controller 1*c*.

Figure 4A:
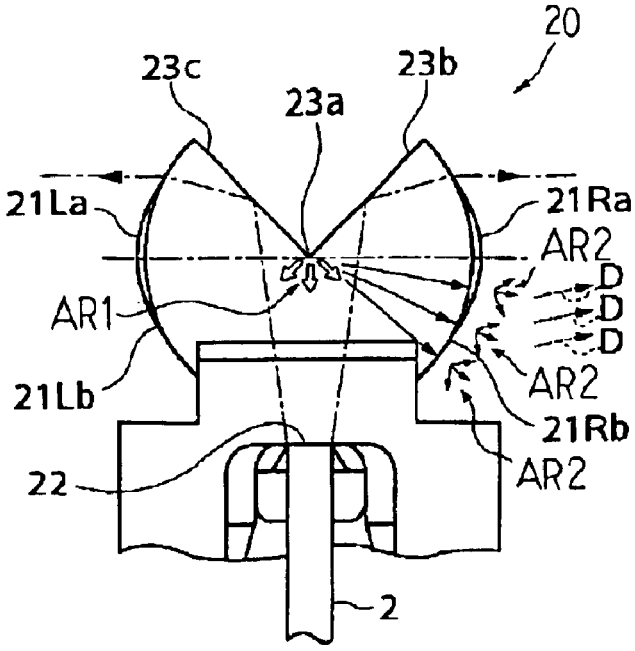
FIG. 4A is a bottom view showing the behavior of light in the light output head portion of the light radiating optical sensor head.

Although the reflection surfaces 23*b* and 23*c* are designed sharply to cross each other at the edge 23*a*, the edge 23*a* is unavoidably rounded in the molding, and the shape around the edge 23*a* is uncontrollable. In other words, it is rare to find the rounded edges 23*a* strictly identical with each other. The light is scattered at the rounded edge 23*a* as indicated by arrows AR1 (see FIG. 4A), and the scattered light, i.e., stray light partially reaches the half 21R*b* of the convex lens 21R. The amount of the stray light is different between the light radiating optical sensor heads 20. Although most of the incident light was directed to the half 131L*b* of the convex lens 131L in the prior art light radiating optical sensor head 130, the light radiating optical sensor head 20 reduces the amount of stray light directed to the half 31L*b* of the convex lens 31 by virtue of the textured surface 21R*b*. In detail, the light incident on the half 21R*b* is irregularly reflected on and refracted in the textured surface 31R*b* as indicated by arrows AR2, and only part of the incident light D is directed to the half 31L*b* of the convex lens 31L. The amount of light D is much less than the amount of light directed to the half 31L*a* of the convex lens 31L, and the amount of light less fluctuates at the light detecting devices 19*a*.

Figure 4B:
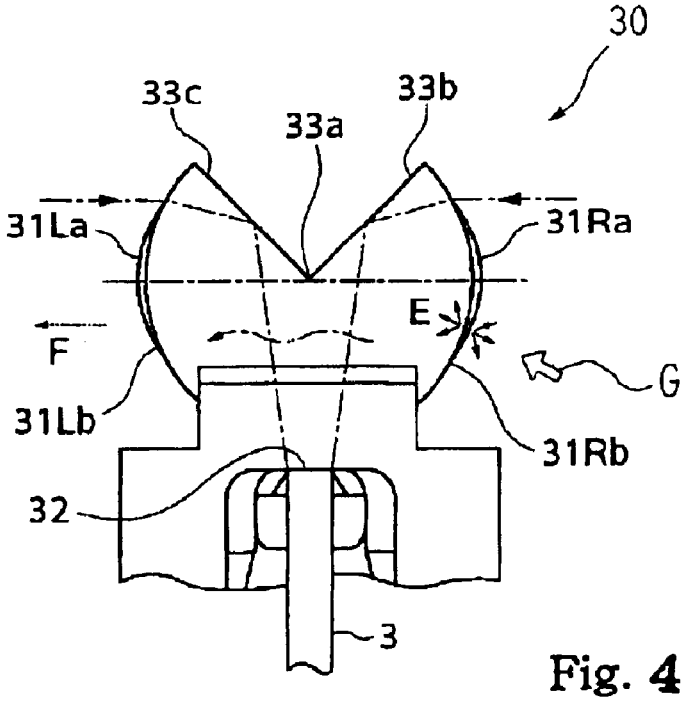
FIG. 4B is a bottom view showing the behavior of light in the light input head portion of the light receiving optical sensor head.

The light D reaches the half 31L*b* of the convex lens 31L as similar to the light G (see FIG. 4B). The light D/G is irregularly reflected on and refracted in the half 31L*b*/31R*b* of the convex lens 31L/31R, and only small part E of the incident light is directed to the edge 33*a*. The edge 33*a* is unavoidably rounded in the molding process, and the shape of the edge 33*a* is uncontrollable. Nevertheless, the amount of light E is extremely small part of the incident light G. The incident light G/D is extremely small part of the light incident on the half 21R*b* of the convex lens 21R, and the amount of the light E is extremely small part of the light G. Thus, even though part of the light E is reflected on the rounded edge 33*a* toward the optical fiber 3, the amount of light incident onto the optical fiber 3 is negligible. For this reason, the optical sensor system according to the present invention does not require the calibration for the electric signals representative of the present positions of the shutter plates 1*a*.

As will be understood from the foregoing description, even though the stray light is unavoidable in the light radiating optical sensor heads 20, the light radiating optical sensor heads 20 make the amount of light D/G reduced through the irregular reflection on and irregular refraction in the textured surfaces 20L*b*/20R*b* of the convex lenses 21L/21R. Moreover, the light receiving optical sensor heads 30 further reduces the amount of light E through the irregular reflection on and irregular refraction in the textured surfaces 31L*b*/31RB of the convex lenses 31L/31R. Although an extremely small part of the stray light is incident onto the light input ends 32 of the optical fibers 3, the fluctuation of the incident light is ignoreable between every two optical fibers 3, and the calibration is not required for the optical sensor system according to the present invention.

Second Embodiment

Figure 5A:
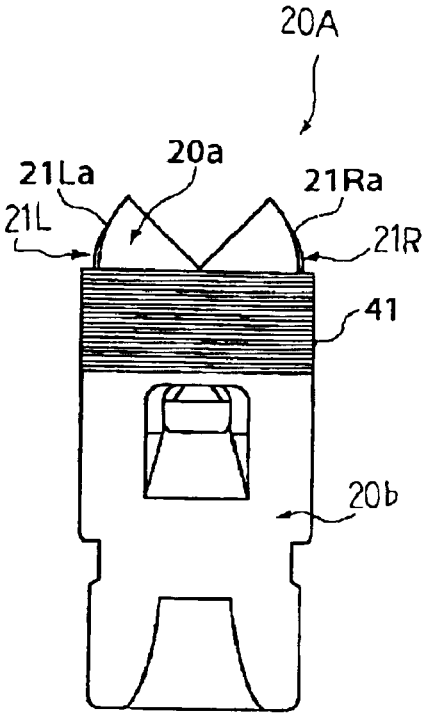
FIG. 5A is a bottom view showing the configuration of a light radiating optical sensor head incorporated in another optical sensor system according to the present invention.
Figure 5B:
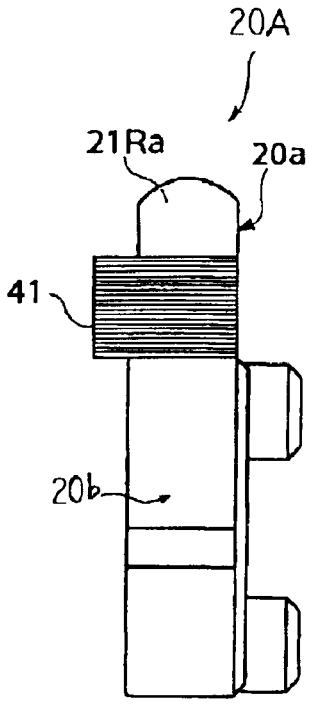
FIG. 5B is a side view showing the light receiving optical sensor head.

FIGS. 5A and 5B show a light radiating optical sensor head 20A incorporated in another optical sensor system embodying the present invention. The system components of the optical sensor system implementing the second embodiment are similar to those of the first embodiment expect the light radiating optical sensor heads 20A and light receiving optical sensor heads (not shown). The light receiving optical sensor heads convex surfaces which are mirror finished. In other words, the light receiving optical sensor heads incorporated in the second embodiment are similar to the light receiving optical sensor heads 130. For this reason, description is hereinafter focused on the light radiating optical sensor head 20A for the sake of simplicity.

A difference between the light radiating optical sensor heads 20A and the light radiating optical sensor heads 20 is a photo-shield member 41. In detail, the light radiating optical sensor head 20A has convex lenses 21L/21R as similar to the light radiating optical sensor head 20, and the convex lenses 21L/21R have at least mirror finished halves 21L*a*/21R*a*. The other halves are covered with the photo-shield member 41. The photo-shield member 41 is made of photo-shield material, and is secured to the light output head portion 20*a*. In this instance, the photo-shield member 41 is formed from a sheet of metal.

The photo-shield member 41 does not permit the halves 21L*b*/21R*b* to radiate the stray light toward the light receiving optical sensor heads. In case where the photo-shield members 41 are provided for the light receiving optical sensor heads, the photo-shield members 41 perfectly prevent the light receiving optical sensor heads from the stray light and environmental light incident onto the halves 31R*b*/31L*b*.

Thus, the photo-shield members 41 perfectly prevent the light receiving optical sensor heads from the stray light so that the manufacturer can install the optical sensor system in the keyboard musical instrument without strict calibration.

Third Embodiment

Figure 6A:
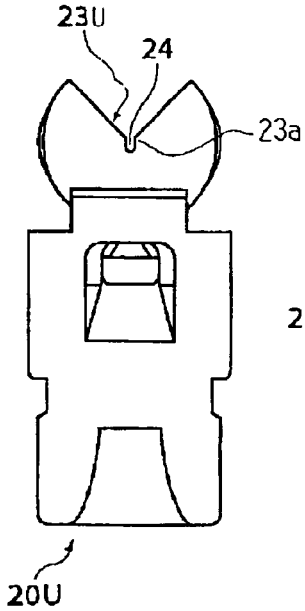
FIG. 6A is a bottom view showing the configuration of a light radiating optical sensor head incorporated in yet another optical sensor system according to the present invention.
Figure 6B:
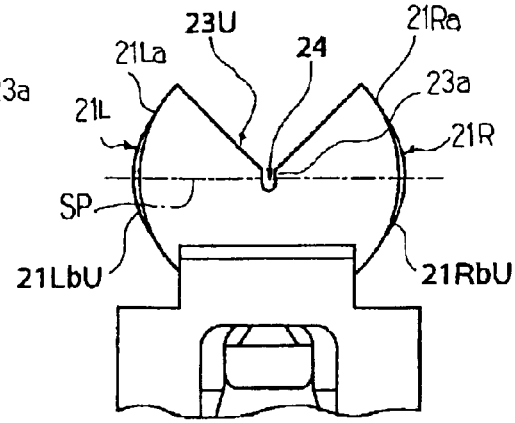
FIG. 6B is a bottom view showing the light output portion of the light receiving optical sensor head.

Turning to FIGS. 6A to 6B, a light radiating optical sensor head 20U incorporated in yet another optical sensor system embodying the present invention. The other system components are similar to those of the first embodiment, and description is hereinafter focused on the light radiating optical sensor head 20U.

A difference between the light radiating optical sensor head 20U and the light radiating optical sensor head 20 is a notch formed at the edge 23*a*. The notch 24 penetrates into the pair of prisms 23U over the planes SP of symmetry, which virtually divide the convex lenses 21L/21R into halves 21L*a*/21R*a* and other halves 21K*b*U/21R*b*U. The notch 24 has a U-letter shaped cross section. A small projection, which is corresponding to the notch 24, may be formed in a molding die unit (not shown) so as to form the notch 24 in the molding process. In this instance, the halves 21R*b*U/21L*b*U are roughened like the textured surface. However, the halves 21R*b*U/21L*b*U may be mirror finished in another instance.

It is possible to well control the shape of the notch 24 through the molding process. A molding die unit is formed with a groove, and a projection, which is corresponding to the notch 24, is inserted into the groove. The groove and, accordingly, the projection are located at the boundary between the inner surfaces corresponding to the reflection surfaces of the prisms 23U, and the projection is well finished. The notch 24 is fairly wide and deep so that the manufacturer can form the projection at target geometry. The well finished surface configuration of the projection is transferred from the molding die unit to the optical sensor heads 20U. Although the light is reflected on the round surfaces, the amount of reflection incident on the halves 21L*b*U/21R*b*U is constant among the light radiating optical sensor heads 20U. Even though part of the reflection is incident onto the light input end 32, the amount of incident light less fluctuates so that the strict calibration is not required for the optical sensor system.

Figure 7:
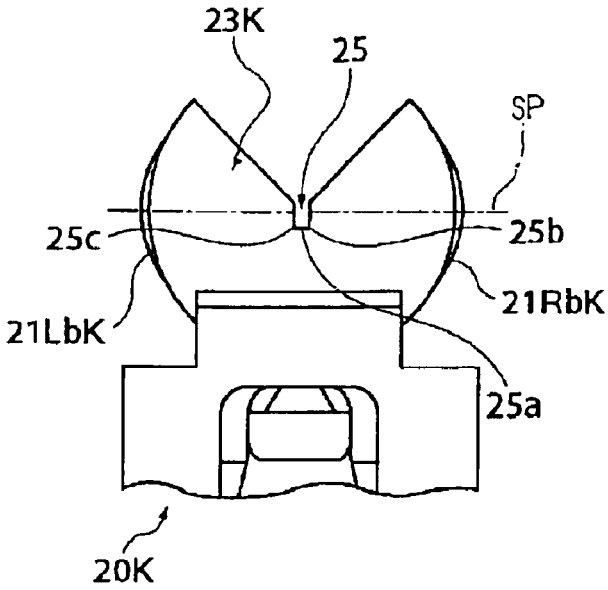
FIG. 7 is a bottom view showing the configuration of still another light radiating optical sensor head according to the present invention.

The notch may have a cross section different from the U-letter shape. FIG. 7 shows still another light radiating optical sensor heads 20K, and another notch 25 is formed in the light output head portion 23K. The notch 25 is defined by a bottom surface 25*a* and a pair of side surfaces 25*b*/25*c*. The bottom surface 25*a* is substantially in parallel to the planes SP of symmetry SP, and the side surfaces 25*b*/25*c* are perpendicular to the planes SP. Although the light is irregularly reflected at the corners of the notches 25, the light passes through the flat bottom surface 25*a* so that the amount of stray light is less than that of the prior art. Although part of stray-light is incident on the light input end 32, the amount of incident light is a little and, accordingly, ignoreable.

Figure 8:
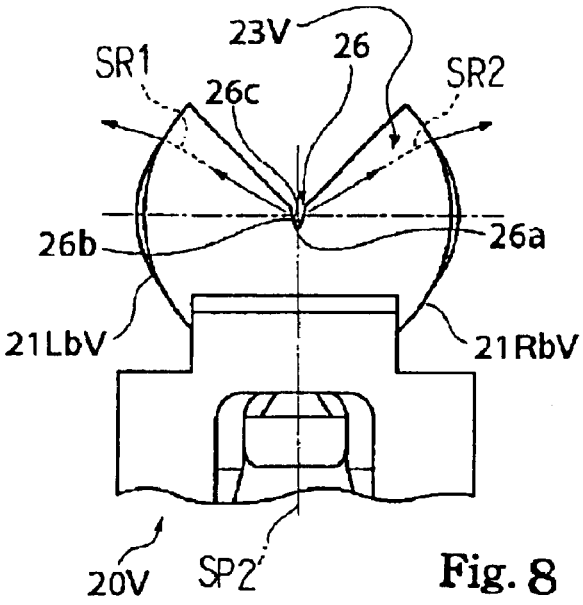
FIG. 8 is a bottom view showing the configuration of yet another light radiating optical sensor head according to the present invention.

FIG. 8 shows yet another light radiating optical sensor heads 20V, and another notch 26 is formed in the light output head portion 23V. The notch 26 has a V-letter cross section. The notch 26 is defined by a pair of side surfaces 26*b*/26*c*, and the side surfaces 26*b*/26*c* cross each other at an acute angle. The acute angle makes the edge 26*a* sharper than the edge 23*a* of the prior art light radiating optical sensor head 130. In other words, the edge 26*a* is less rounded. For this reason, although the light is reflected on the side surfaces 26*b*/26*c*, the direction of the reflections SR1/SR2 are predictable on the basis of the angle between the side surfaces 26*b*/26*c* and the plane of symmetry SP2. Although part of the reflection is incident onto the light input end 32, the amount of incident light less fluctuates, and the strict calibration is not required for the optical sensor system.

As will be understood, although the notches 24/25/26 do not reduce the stray light incident onto the light input ends 32 of the light receiving optical sensor heads, the notches 24/25/26 are effective against the fluctuation in the amount of incident light, because the shapes of notches 24/25/26 are well controlled through the molding process. The approach employed in the third embodiment and modifications thereof is different from the approach employed in the first and second embodiment. Nevertheless, the concept of the first and second embodiments and the concept of the third embodiment and modifications thereof are fallen within a superordinate concept that the fluctuation in the amount of light incident onto the optical fibers 3 is to be suppressed.

Fourth Embodiment

Figure 9A:
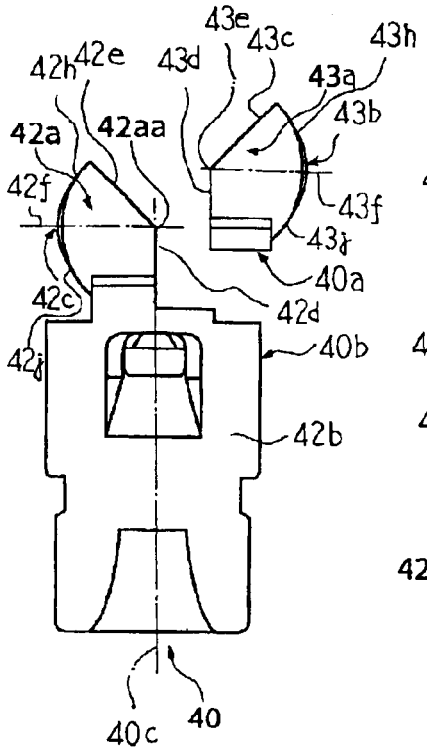
FIG. 9A is a bottom view showing parts of still another light radiating optical sensor head.
Figure 9B:
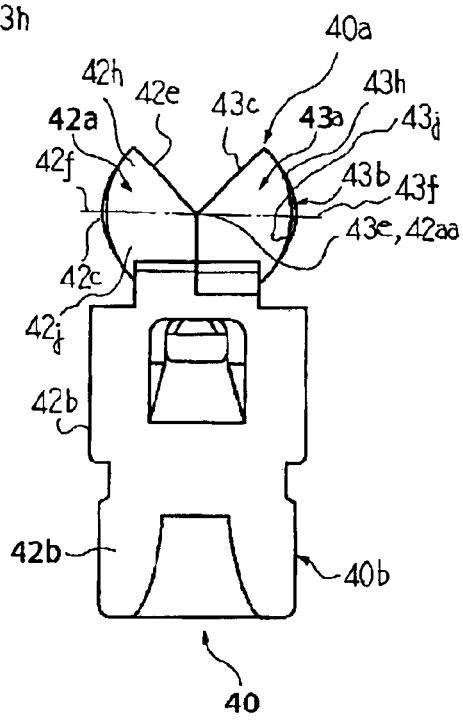
FIG. 9B is a bottom view showing the parts assembled into the light radiating optical sensor head.

Turning to FIGS. 9A and 9B, still another light radiating optical sensor head 40 comprises two parts 40*a* and 40*b*. The light radiating optical sensor head 40 forms a part of an optical sensor system embodying the present invention. However, the system components are similar to those of the first embodiment except for the light radiating optical sensor heads 40. For this reason, description is focused on the light radiating optical sensor head 40.

One of the parts 40*a*/40*b* includes a prism 43*a* and a convex lens 43*b*, which are respectively corresponding to one of the prisms 23 and convex lens 21R. The prism 43*a* has a reflection surface 43*c*, and the reflection surface 43*c* crosses a split surface 43*d* of the part 40*a* at an edge 43*e*. The reflection surface 43*c* inclines at 45 degrees from an extension of the split surface 43*d*, and the edge 43*e* is sharp. The split surface 43*d* has a predetermined length. The convex lens 43*b* is symmetrical with a plane 43*f* of symmetry, and is virtually split into halves 43*h* and 43*j*. The half 43*h* is mirror finished, and the other half 43*j* is roughened like the textured surface. However, both halves 43*h*/43*j* may be mirror finished.

On the other hand, the other part 40*b* includes a prism 42*a*, a body portion 42*b* and a convex lens 42*c*. The body portion 42*b* is similar to the body portion 20*b*, and is symmetrical with respect to a plane 40*c* of symmetry. The part 40*b* has a split surface 42*d*, which is coplanar with the plane 40*c* of symmetry, and the split surface 42*d* has the predetermined length. The prism 42*a* has a reflection surface 42*e*, and the reflection surface 42*e* crosses the split surface 42*d* at an edge 42*aa*. The edge 42*aa* is sharp. The reflection surface 42*e* inclines at 45 degrees with respect to the plane 40*c* of symmetry. The lens 42*c* is symmetrical with a plane 42*f* of symmetry, and is virtually split into halves 42*h* and 42*j*. The half 42*h* is mirror finished, and the other half is roughened like the textured surface. However, both halves 42*h* and 42*j* may be mirror finished. Both of the parts 40*a* and 40*b* are produced through the molding process.

The parts 40*a*/40*b* are assembled into the light radiating optical sensor head 40 as follows. First, adhesive compound is spread over the split surfaces 42*d*/43*d*. The split surface 42*d* is faced to the split surface 43*d*, and is pressed to the split surface 43*d*. Then, the edge 43*e* is brought into coincident with the edge 42*aa* as shown in FIG. 9B, and the reflection surfaces 42*e* and 43*c* are spaced from each other by 90 degrees. The plane of symmetry 43*f* is further aligned with the plane of symmetry 42*f*. Since the edges 43*e* and 42*aa* are sharp, the reflection surface 43*c* crosses the other reflection surface 42*e* without forming any rounded edge.

As will be understood from the foregoing description, the light radiating optical sensor head 40 has the edge 43*e*/42*aa* formed at the crossing line between the reflection surfaces 42*e*/43*c* by separating it into plural parts. The light radiating optical sensor head 40 is based on a concept that the stray light is to be reduced by making the edge 43*e*/42*aa* sharp. Although the concept employed in the fourth embodiment is different from the concept employed in the first and second embodiments and the concept employed in the third embodiment, the light radiating optical sensor head 40 is also fallen within the superordinary concept that the fluctuation in the amount of light incident onto the optical fibers 3 is to be suppressed.

Although particular embodiments of the present invention have been shown and described, it will be apparent to those skilled in the art that various changes and modifications may be made without departing from the spirit and scope of the present invention.

For example, the keyboard musical instrument does not set any limit on the scope of the present invention. The optical sensor system may be incorporated in another sort of keyboard musical instrument such as, for example, an automatic player piano, another sort of musical instrument such as, for example, electronic stringed instrument and electronic wind instrument and another sort of electronic good such as, for example, industrial machinery.

In the first embodiment, both light radiating and light receiving optical sensor heads have the textured surfaces 21L*b*/21R*b* and 31L*b*/31R*b*. However, either light radiating optical sensor heads 30 or light receiving optical sensor heads may have the textured surfaces 21L*b*/21R*b* or 31L*b*/31R*b* in so far as the fluctuation is admittable in an application of the optical sensor system.

The textured surfaces are a mere example of the roughened surfaces. Any sort of roughened surfaces is available for the optical sensor heads 20/30 in so far as the amount of stray light is reduced through the irregular reflection and/or irregular refraction.

In the second embodiment, the light receiving optical sensor heads 30 may have the halves 31L*b*/31R*b* roughened as similar to those of the first embodiment. Otherwise, the light receiving optical sensor heads 30 may have the photo-shield members 41 instead of the roughened halves 31L*b*/31R*b*.

A photo-shield layer may be adhered to, coated on or deposited on the halves 21L*b*/21R*b*. For example, black paint may be spread on the halves 21R*b*/21L*b*.

The photo-shield member or layer may be semi-transparent. Even though part of the stray light passes through the semi-transparent member or layer, the manufacturer can install the optical sensor system in an application without strict calibration in so far as the fluctuation is acceptable.

In the modifications shown in FIGS. 7 and 8, the halves 21L*b*K/21R*b*K and 21L*b*V/21R*b*V may be roughened like the textured surface.

The cross sections of the notches 24/25/26 do not set any limit to the technical scope of the present invention. The light radiating optical sensor heads 20U/20K/20V may have the roughened halves of the convex lenses. Otherwise, the photo-shield members 41 may be provided for the light radiating optical sensor heads 20U/20K/20V.

In the fourth embodiment, the light radiating optical sensor head 40 is split into the two parts 40*a*/40*b*. However, the light radiating optical sensor head 40 may be split into more than two parts. For example, the light radiating optical sensor head 40 may be split into three portions 42*a*/42*c*, 42*b* and 40*a*.

The transparent optical fibers 2/3 do not set any limit to the technical scope of the present invention. If the light emitting unit 10 emits infrared light and, accordingly, the light detecting unit 19 converts the infrared light to electric charge, the optical fibers 2 and 3 are colored.

Figure 10:
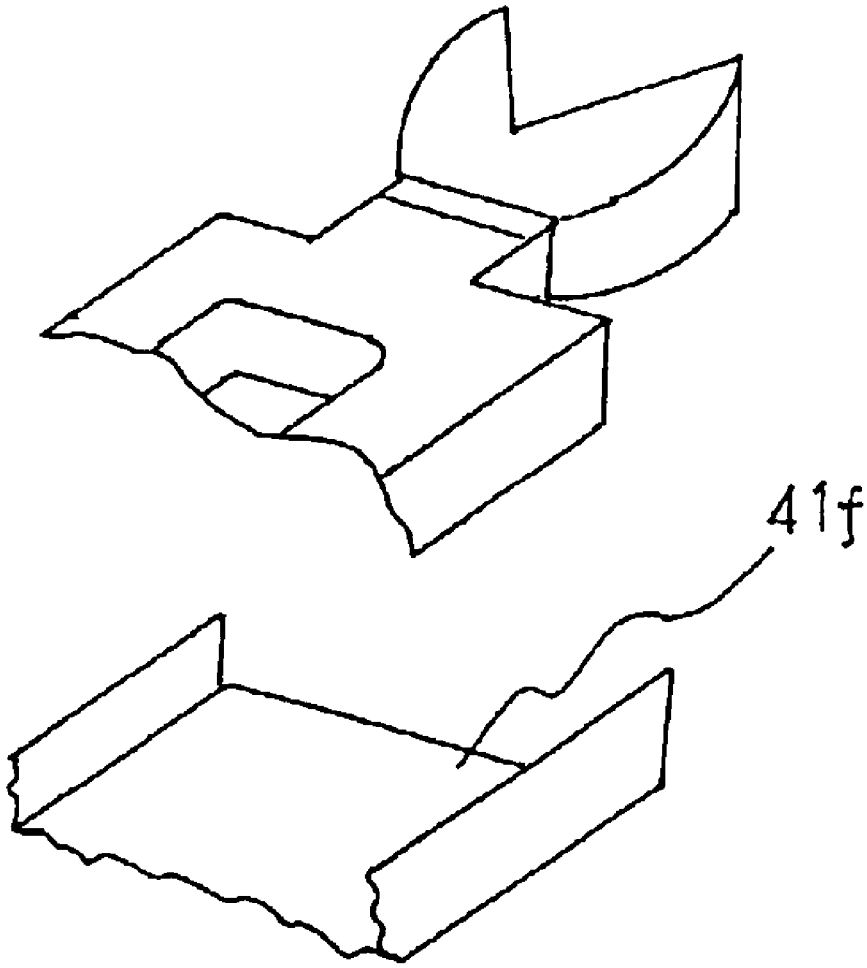
FIG. 10 is a perspective view showing an example of a photo-shield member.

The photo-shield member 41 may be implemented by a non-transparent cover plate 41*f* shown in FIG. 10.

Claim languages are correlated with the system components and parts as follows. The body portion 20*b* and 42*b* and the head portions 20*a* and 30*a*/ the combination of prisms and convex lenses 42*a*, 43*a*, 42*c* and 43*b* serve as a body portion and a head portion, respectively, and the textured surfaces 21L*b*/21R*b*/31L*b*/31R*b*, the photo-shield member 41 and the sharp edge 43*e*/42*aa* are corresponding to a stray light reducing member. The body portion and the head portion shown in FIGS. 6A, 6B, 7 and 8 serve as a body portion and a head portion, and the notches 24/25/26 are corresponding to a stray light controlling member. The textured surfaces 21L*b*/21R*b*/31L*b*/31R*b*, the photo-shield member 41, the sharp edge 43*e*/42*aa* and the notches 24/25/26 serve as a suppressing member.

The entire disclosure of Priority Document. 2002-123744 is incorporated herein by reference.

What is claimed is:

1. An optical sensor head comprising:

a body portion having an optical path for light; and a head portion connected to said body portion, formed with reflection surfaces extending from an edge on said optical path in different directions for splitting said light into plural beams through reflection thereon, and having a stray light reducing member for reducing the amount of stray light unavoidably produced at said edge.

2. The optical sensor head as set forth in claim 1, in which said body portion and said head portion form parts of a monolithic molded piece.

3. The optical sensor head as set forth in claim 2, in which said monolithic molded piece is formed with rough surfaces outside of optical paths respectively assigned to said light beams and causative of scattering said stray light, and said rough surfaces serve as said stray light reducing member by reducing the amount of stray light directed to certain points on said optical paths respectively assigned to said light beams by scattering said stray light.

4. The optical sensor heads as set forth in claim 3, in which said rough surfaces are causative of irregular reflection and irregular refraction for scattering said stray light.

5. The optical sensor head as set forth in claim 3, in which said rough surfaces have a texture pattern.

6. The optical sensor head as set forth in claim 2, in which said monolithic molded piece has certain surfaces through which optical paths respectively assigned to said light beams extend and other surfaces adjacent to said certain surfaces, and an obstacle is provided for said other surfaces so as to reduce the amount of said stray light directed to certain points on said optical paths respectively assigned to said light beams.

7. The optical sensor head as set forth in claim 6, in which said obstacle is a photo-shield layer.

8. The optical sensor head as set forth in claim 7, in which said photo-shield layer is provided between said other surfaces and said certain points.

9. The optical sensor head as set forth in claim 6, in which said other surfaces are roughened.

10. The optical sensor head as set forth in claim 1, in which two parts have said respective reflection surfaces and split surfaces respectively sharply crossing said reflection surfaces, and said split surfaces are held in contact with each other so as to make said edge sharp.

11. The optical sensor head as set forth in claim 10, in which said split surfaces are provided on said optical path for said light.

12. The optical sensor head as set forth in claim 10, in which said two parts further have certain surfaces through which said light beams pass and rough surfaces adjacent to said certain surfaces for scattering said stray light.

13. An optical sensor head comprising:

a body portion having an optical path for light; and a head portion connected to said body portion, formed with reflection surfaces extending from an edge on said optical path in different directions for splitting said light into plural beams through reflection thereon, and having a stray light controller for making the amount of stray light at said edge predictable.

14. The optical sensor head as set forth in claim 13, in which said body portion and said head portion form parts of a monolithic molded piece.

15. The optical sensor head as set forth in claim 14, in which said monolithic molded piece is formed with a hollow space projecting from said edge toward said body portion, and said hollow space has a target shape in such a manner as to make the amount of stray light directed to certain points on optical paths for said light beams predictable.

16. The optical sensor head as set forth in claim 15, in which said hollow space extends from said edge along said optical path for said light so that said stray light is generated on the surface defining said hollow space.

17. The optical sensor head as set forth in claim 15, in which said hollow space has a U-letter shaped cross section.

18. The optical sensor head as set forth in claim 15, in which said hollow space has a rectangular cross section.

19. The optical sensor head as set forth in claim 15, in which said hollow space has a V-letter shaped cross section.

20. The optical sensor head as set forth in claim 15, in which said monolithic molded piece further has certain surfaces through which said light beams pass and rough surfaces respectively adjacent to said certain surfaces for scattering said stray light.

21. The optical sensor head as set forth in claim 15, in which said monolithic molded piece further has certain surfaces through which said light beams pass and other surfaces respectively adjacent to said certain surfaces for reducing the amount of stray light passing therethrough.

22. An optical sensor system for converting present positions of moving objects to electric signals, comprising:

a light emitting unit for emitting light;

at least one light radiating optical sensor head connected through an optical fiber to said light emitting unit, and including a body portion offering an optical path to said light and a head portion connected to said body portion, formed with reflection surfaces extending from an edge on said optical path in different directions for splitting said light into light beams through reflection thereon and having a suppressing member for reducing fluctuation of the amount of said light beams;

at least two light receiving optical sensor heads sideward spaced from said at least one light radiating optical sensor head for permitting said moving objects to pass through gaps, and respectively receiving said light beams; and a light detecting unit connected through optical fibers to said at least two light receiving optical sensor heads, respectively, and converting said light beams to said electric signals.

23. The optical sensor system as set forth in claim 22, in which said head portion has certain surfaces through which said light beams pass and rough surfaces respectively adjacent to said certain surfaces and scattering stray light generated at said edge for reducing said fluctuation, and said rough surfaces serve as said suppressing member.

24. The optical sensor system as set forth in claim 22, in which said head portion has certain surfaces through which said light beams pass and other surfaces respectively adjacent to said certain surfaces, and said suppressing member serves as an obstacle against stray light generated at said edge for reducing said fluctuation.

25. The optical sensor system as set forth in claim 22, in which said head portion includes two parts having the respective reflection surfaces and split surfaces sharply crossing said respective reflection surfaces, and said split surfaces are held in contact with each other for making said edge sharp so that the amount of stray light at said edge is reduced.

26. The optical sensor system as set forth in claim 22, in which said head portion is formed with a hollow space projecting from said edge toward said body portion, and said hollow space is defined by a surface serving as said suppressing member and having a target geometry for making stray light generated at said edge predictable.

27. The optical sensor system as set forth in claim 22, in which each of said at least two light receiving optical sensor heads has another suppressing member for further reducing said fluctuation.

28. The optical sensor system as set forth in claim 27, in which said each of said at least two light receiving optical sensor head has a certain surface through which one of said light beams passes and a rough surface adjacent to said one of said certain surfaces and scattering stray light generated at said edge for reducing said fluctuation, and said rough surface serves as said another suppressing member.

29. The optical sensor system as set forth in claim 27, in which said each of said at least two light receiving optical sensor heads has a certain surface through which one of said light beams passes and another surface adjacent to said certain surface, and said another suppressing member serves as an obstacle against stray light generated at said edge for reducing said fluctuation.

* * * * *